US007796138B2

(12) United States Patent
Weitbruch et al.

(10) Patent No.: US 7,796,138 B2
(45) Date of Patent: Sep. 14, 2010

(54) METHOD AND DEVICE FOR PROCESSING VIDEO DATA BY USING SPECIFIC BORDER CODING

(75) Inventors: Sébastien Weitbruch, Kappel (DE); Cédric Thebault, Villingen-Schwenningen (DE); Carlos Correa, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 519 days.

(21) Appl. No.: 10/584,743

(22) PCT Filed: Dec. 20, 2004

(86) PCT No.: PCT/EP2004/053603

§ 371 (c)(1),
(2), (4) Date: Jun. 26, 2006

(87) PCT Pub. No.: WO2005/069262

PCT Pub. Date: Jul. 28, 2005

(65) Prior Publication Data

US 2007/0154101 A1 Jul. 5, 2007

(30) Foreign Application Priority Data

Jan. 7, 2004 (EP) ..... 04100030

(51) Int. Cl.
*G09G 5/00* (2006.01)

(52) U.S. Cl. ..... 345/581; 345/60; 345/596

(58) Field of Classification Search ..... 345/581
See application file for complete search history.

(56) References Cited

U.S. PATENT DOCUMENTS

| | | | | |
|---|---|---|---|---|
| 6,268,890 | B1 * | 7/2001 | Kawahara | 348/739 |
| 6,388,677 | B1 * | 5/2002 | Doyen et al. | 345/690 |
| 6,417,824 | B1 * | 7/2002 | Tokunaga et al. | 345/60 |
| 6,727,913 | B2 * | 4/2004 | Hoppenbrouwers et al. | 345/690 |
| 6,882,351 | B2 * | 4/2005 | Morita | 345/690 |
| 6,922,181 | B2 * | 7/2005 | Tanaka et al. | 345/63 |
| 7,158,155 | B2 * | 1/2007 | Ueda et al. | 345/690 |
| 2003/0076338 | A1 * | 4/2003 | Hashimoto | 345/690 |
| 2003/0193451 | A1 * | 10/2003 | Kimura | 345/60 |

OTHER PUBLICATIONS

S. Weitbruch et al: "High Contrast PDP Based on New Specific Sub-Field Structure", ASIS Display/IDW'01. Proceedings of the 21st International Display Research Conference in Conjunction With the 8th International Display Workshops. Nagoya, Japan, Oct. 16-19, 2001, vol. Conf. 21/8, pp. 861-864.
Search Report Dated Jul. 19, 2005.

* cited by examiner

*Primary Examiner*—Xiao M Wu
*Assistant Examiner*—Maurice McDowell, Jr.
(74) *Attorney, Agent, or Firm*—Robert D. Shedd; Harvey D. Fried; James McKenzie

(57) ABSTRACT

Response fidelity problems appear for some specific video levels at PDP borders. The reason is that some cells at the border of the PDP panel are not completely closed and pollute when switched ON neighbouring cells being OFF. Therefore, it is suggested to encode the video levels in the border area in a specific way. Especially, for critical sub-fields within the code it is forbidden to insert a binary 0 between two binary 1. Thus, the neighbourhood of critical sub-fields being ON and OFF is avoided. Preferably, the specific border coding is performed under the control of an average power management and codewords being not used are recreated by dithering.

14 Claims, 15 Drawing Sheets

Response fidelity issues at border

Low sustains number (255)

High sustains number (765)

Figure 1:
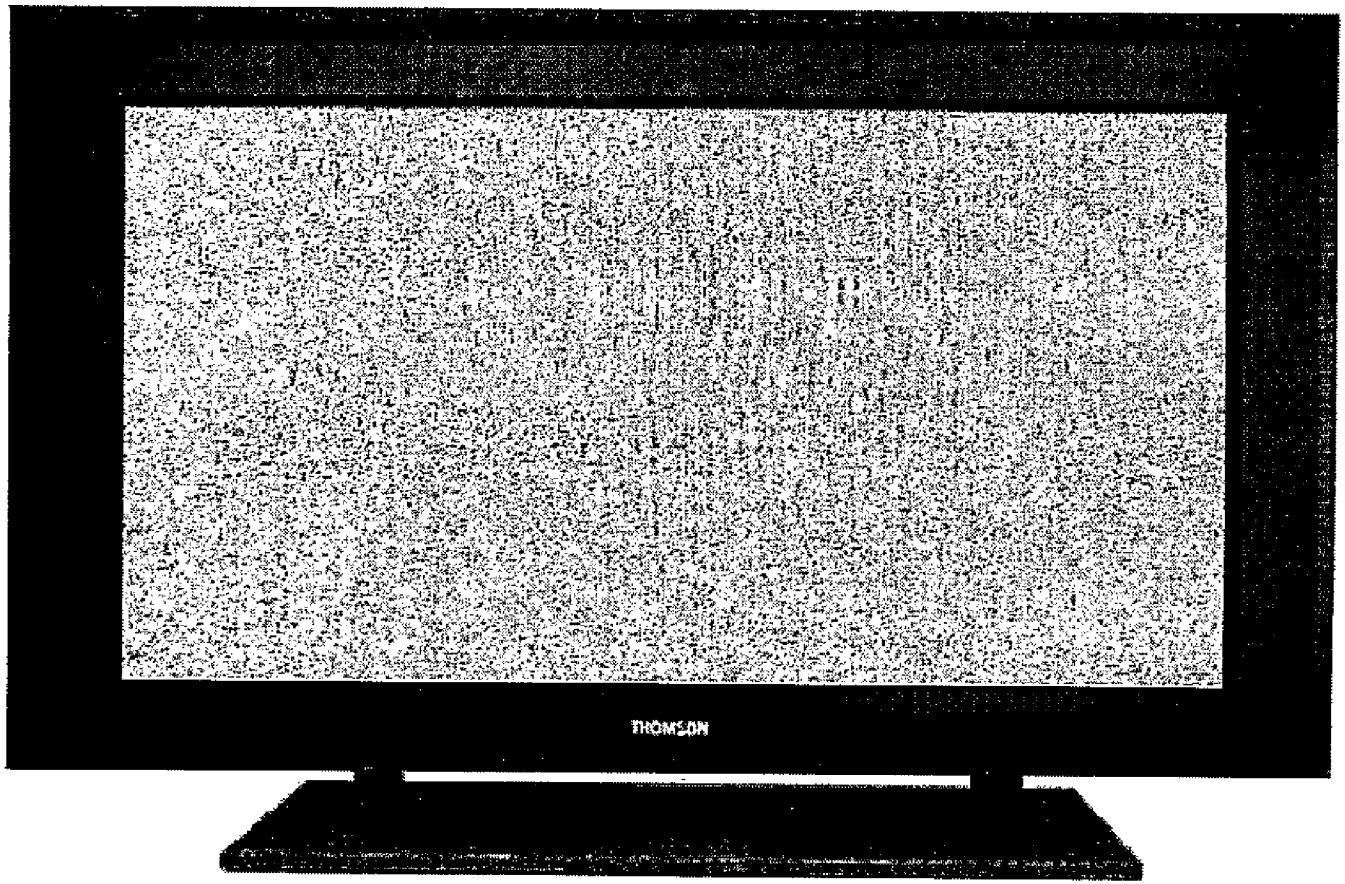

| | | | | | | | | | | | | | | | | |
|---|---|---|---|---|---|---|---|---|---|---|---|---|---|---|---|---|
| 170 | 170 | 170 | 170 | 170 | 170 | 170 | 176 | 170 | 176 | 170 | 176 | 176 | 176 | 176 | 176 | 176 |
| 170 | 170 | 170 | 170 | 170 | 170 | 176 | 170 | 176 | 170 | 176 | 176 | 176 | 176 | 176 | 176 | 176 |
| 170 | 170 | 170 | 170 | 170 | 170 | 170 | 176 | 170 | 176 | 170 | 176 | 176 | 176 | 176 | 176 | 176 |
| 170 | 170 | 170 | 170 | 170 | 170 | 176 | 170 | 176 | 170 | 176 | 176 | 176 | 176 | 176 | 176 | 176 |
| 170 | 170 | 170 | 170 | 170 | 170 | 170 | 176 | 170 | 176 | 170 | 176 | 176 | 176 | 176 | 176 | 176 |
| 170 | 170 | 170 | 170 | 170 | 170 | 176 | 170 | 176 | 170 | 176 | 176 | 176 | 176 | 176 | 176 | 176 |
| 170 | 170 | 170 | 170 | 170 | 170 | 170 | 176 | 170 | 176 | 170 | 176 | 176 | 176 | 176 | 176 | 176 |
| 170 | 170 | 170 | 170 | 170 | 170 | 176 | 170 | 176 | 170 | 176 | 176 | 176 | 176 | 176 | 176 | 176 |

Cells with problems

Fig.8

170 ⇨ 111111101110

*Differences*

176 ⇨ 111111011110

Fig. 9

| | | | | | | | | | | | | | | | |
|---|---|---|---|---|---|---|---|---|---|---|---|---|---|---|---|
| 173 | 173 | 173 | 173 | 173 | 173 | 174 | 173 | 174 | 173 | 174 | 174 | 174 | 174 | 174 | 174 |
| 173 | 173 | 173 | 173 | 173 | 173 | 173 | 174 | 173 | 174 | 174 | 174 | 174 | 174 | 174 | 174 |
| 173 | 173 | 173 | 173 | 173 | 173 | 174 | 173 | 174 | 173 | 174 | 174 | 174 | 174 | 174 | 174 |
| 173 | 173 | 173 | 173 | 173 | 173 | 173 | 174 | 173 | 174 | 174 | 174 | 174 | 174 | 174 | 174 |
| 173 | 173 | 173 | 173 | 173 | 173 | 174 | 173 | 174 | 173 | 174 | 174 | 174 | 174 | 174 | 174 |
| 173 | 173 | 173 | 173 | 173 | 173 | 173 | 174 | 173 | 174 | 174 | 174 | 174 | 174 | 174 | 174 |
| 173 | 173 | 173 | 173 | 173 | 173 | 174 | 173 | 174 | 173 | 174 | 174 | 174 | 174 | 174 | 174 |
| 173 | 173 | 173 | 173 | 173 | 173 | 173 | 174 | 173 | 174 | 174 | 174 | 174 | 174 | 174 | 174 |

Fig. 10

173 ⇨ 110111011110

*Differences*

174 ⇨ 101111011110

Fig. 11

| Weight | 1 | 2 | 3 | 5 | 8 | 13 | 19 | 25 | 32 | 40 | 49 | 58 | Σ=255 |
|---|---|---|---|---|---|---|---|---|---|---|---|---|---|
| **APL** | ***Number of sustain periods per sub-field*** | | | | | | | | | | | | **Total** |
| 0% | 5 | 11 | 16 | 27 | 44 | 71 | 104 | 136 | 175 | 218 | 267 | 316 | Σ=1391 |
| 20% | 3 | 7 | 10 | 17 | 27 | 45 | 65 | 86 | 110 | 137 | 168 | 199 | Σ=875 |
| 40% | 2 | 4 | 6 | 11 | 17 | 28 | 41 | 53 | 68 | 85 | 105 | 124 | Σ=544 |
| 60% | 1 | 3 | 4 | 7 | 11 | 17 | 25 | 33 | 43 | 53 | 66 | 78 | Σ=341 |
| 80% | 1 | 2 | 2 | 4 | 7 | 11 | 16 | 21 | 26 | 33 | 40 | 48 | Σ=210 |
| 100% | 1 | 1 | 1 | 2 | 4 | 6 | 9 | 12 | 16 | 20 | 24 | 28 | Σ=124 |

Fig. 16

| Weight | 1 | 2 | 3 | 5 | 8 | 13 | 19 | 25 | 32 | 40 | 49 | 58 | Σ=255 |
|---|---|---|---|---|---|---|---|---|---|---|---|---|---|
| **APL** | ***Number of sustain periods per sub-field*** | | | | | | | | | | | | **Total** |
| 0% | 5 | 11 | 16 | 27 | 44 | 71 | 104 | 136 | 175 | 218 | 267 | 316 | Σ=1391 |
| 20% | 3 | 7 | 10 | 17 | 27 | 45 | 65 | 86 | 110 | 137 | 168 | 199 | Σ=875 |
| 40% | 2 | 4 | 6 | 11 | 17 | 28 | 41 | 53 | 68 | 85 | 105 | 124 | Σ=544 |
| 60% | 1 | 3 | 4 | 7 | 11 | 17 | 25 | 33 | 43 | 53 | 66 | 78 | Σ=341 |
| 80% | 1 | 2 | 2 | 4 | 7 | 11 | 16 | 21 | 26 | 33 | 40 | 48 | Σ=210 |
| 100% | 1 | 1 | 1 | 2 | 4 | 6 | 9 | 12 | 16 | 20 | 24 | 28 | Σ=124 |

Fig. 17

METHOD AND DEVICE FOR PROCESSING VIDEO DATA BY USING SPECIFIC BORDER CODING

This application claims the benefit, under 35 U.S.C. §365 of International Application PCT/EP2004/053603, filed Dec. 20,2004, which was published in accordance with PCT Article 21(2) on Jul. 28, 2005 in English and which claims the benefit of Europeanpatent application No. 04100030.8, filed Jan. 7, 2004.

The present invention relates to a method for processing video data to be displayed on a display screen by providing said video data having video levels selected from a predetermined number of video levels, encoding said predetermined number of video levels with a corresponding number of codewords and illuminating pixels in a central area of said display screen in accordance with said codewords.

Furthermore, the present invention relates to a corresponding device for processing video data.

BACKGROUND

Referring to the last generation of CRT displays, a lot of work has been done to improve its picture quality. Consequently, a new technology like Plasma has to provide a picture quality at least as good or even better than standard CRT technology. For a TV consumer, high contrast is one main factor for a high subjective picture quality of a given display. The dark room contrast is defined as the ratio between the maximal luminance of the screen (peak-white) and the black level. Today, on plasma display panels (PDP), contrast values are inferior to those achieved for CRTs.

This limitation depends on two factors:

The brightness of the screen is limited by the panel efficacy that in general is lower than that of a CRT for a given power consumption. Nevertheless, the PDP efficacy has been constantly improved during the last years for the benefit of contrast.

The black level of the PDP screen is not completely dark like on a CRT. In fact, a backlight is emitted even while displaying no video signal. The plasma technology requires for the successful writing of a cell a kind of pre-excitation in the form of a regularly priming signal representing an overall pre-lighting of all plasma cells. This priming operation is responsible for the backlight, which drastically reduces the PDP contrast ratio. This reduction is mostly visible in a dark room environment representing the major situation for video applications (home theatre etc.)

In the following, aspects of response fidelity and priming are presented in more detail.

A panel having good response fidelity ensures that only one pixel could be ON in the middle of a black screen and in addition, this panel has a good homogeneity. FIG. 1 illustrates a white page displayed on PDP having response fidelity problems. The response fidelity problems appear in the form of misfiring of cells having too much inertia. Such cells require more time for writing as available.

A first solution to achieve good response fidelity, by standard PDPs and for a given addressing speed, leads to the priming operation mentioned above. In that case, each cell will be repeatingly excited. Nevertheless, since an excitation of a cell is characterized by an emission of light, this has to be done parsimoniously to avoid a strong reduction of the dark room contrast (i.e. to avoid more background luminance). Therefore a simple way to improve the dark room contrast leads to an optimization of the priming use.

Actually, two kinds of priming can be found on the market:

"Hard-priming" which generates more backlight (e.g. 0.8 cd/m$^2$) but which has a very high efficacy. Usually, one single "hard priming" per video frame is sufficient.

"Soft-priming" which generates less backlight (e.g. 0.1 cd/m$^2$) than the previous one but has less efficacy. On many products, this priming is used for each sub-field, which leads to a very poor dark room contrast again.

Obviously, the better solution should be based on the use of a "soft-priming" with the assumption that the total amount of "soft-priming" required to obtain an acceptable response fidelity will produce less light than a single "hard-priming". This is not the case when the coding has not been optimized since one priming per sub-field should be required.

In fact, the best contrast ratio will be obtained by using a single soft-priming operation per frame. Such a concept is achieved by optimization of the coding concept as seen in the next paragraph.

Figure 2:
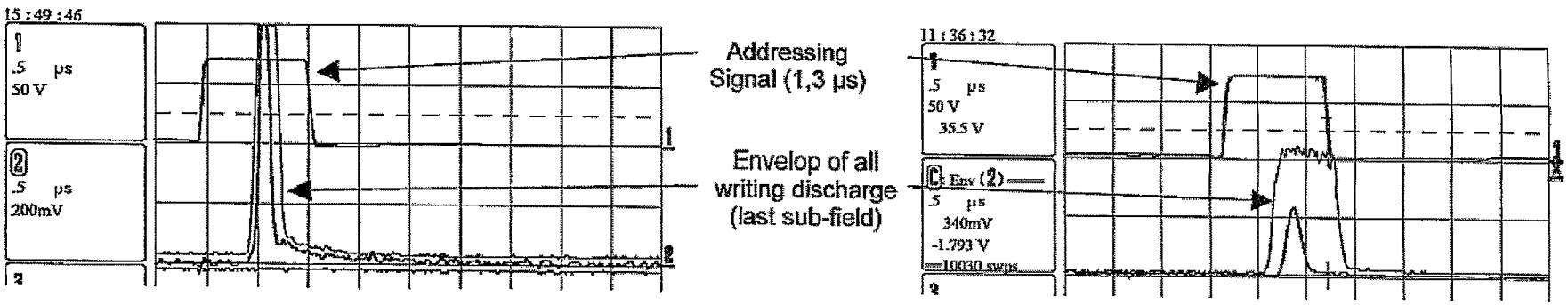

The document EP-A-1 250 696 introduces a concept of one single "soft-priming", where only one priming at the beginning of a frame is performed. In that case, only the first sub-fields will be near enough from the priming signal in the time domain to benefit from it. Now, the main idea was to use these first sub-fields as a kind of "artificial priming" for the next sub-fields taking the assumption that one lighted sub-field will help the writing of the next ones (cascade effect). FIG. 2 illustrates this "cascade effect" in the case of a 12 sub-fields code by analyzing the jitter of the writing discharge for the last sub-field (most significant bit MSB). It represents the statistic distribution of the writing discharge of the last sub-field inside the plasma cell for two different codewords by respective envelope curves. In both situations, there is only one priming (P) at the beginning of the frame (not shown).

In the first case, the codeword used (P-101111111101) enables a good cascade effect from the priming P up to the last sub-field (MSB). Then, the distribution of the writing discharge is well concentrated and fully occur inside 1.1 μs which represents the new borderline for the address speed. This means, that the writing process can be performed within the addressing period.

In the second case, the codeword used (P-000000000001) does not permit any cascade effect and therefore the writing of the last sub-field is less efficient. Then, the distribution of the writing discharge is no more concentrated and is spread on a longer time period as shown by the envelope. Thus some writing process would be performed after the addressing period. In that case, more time should be given to the addressing for acceptable response fidelity.

The results presented in FIG. 2 have shown that good response fidelity can be obtained through a kind of cascade effect from the priming up to the highest sub-field. In that case the initialization started with the priming will spread like a wild fire among the whole frame. Therefore, an optimized concept will require a concentration of energy around the low sub-fields, which are the most critical ones to ensure them a maximal benefit from the priming. In addition to that, the time delay between two consecutives lighted sub-fields should be kept as small as possible to increase the influence between them and to produce an optimal cascade effect starting with the priming.

Figure 3:
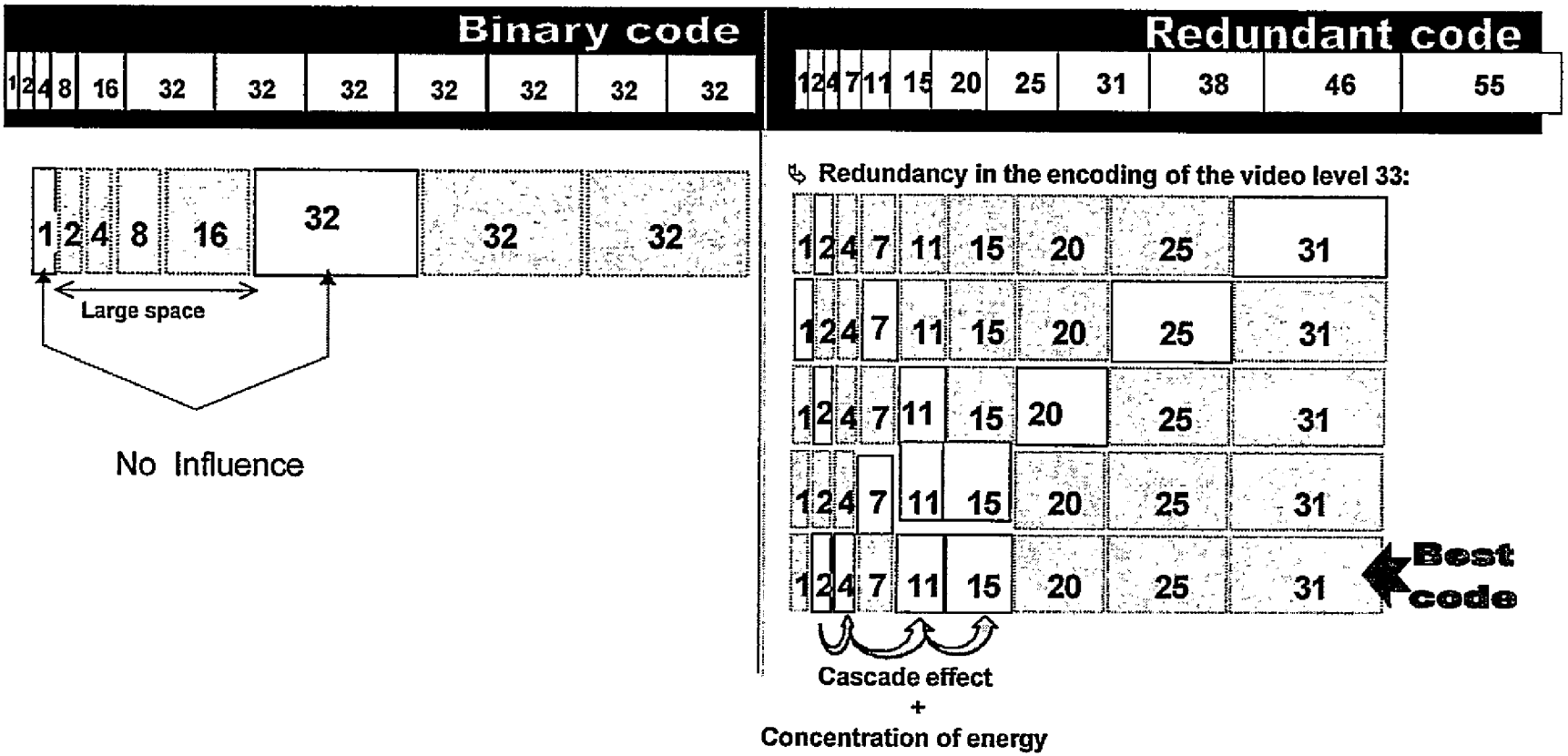

FIG. 3 illustrates various ways to encode the video level 33 with two different sub-field organizations. Depending on the sub-fields organization, there are one or more encoding possibilities for a video value. A binary code shown on the left side of FIG. 3 leads to a large space between two sub-fields ON. Therefore, there is no influence between these sub-fields and no concentration of energy in the low sub-fields. As a result, more priming or longer addressing time is needed. A redundant code presented on the right side of FIG. 3 enables a better concentration of the energy around the priming and also enables to reduce the distance between two sub-fields ON so that the cascade effect can be utilized.

Moreover, the optimal sub-fields encoding should enable to have not more than one sub-field OFF between two sub-fields ON. This property will be called Single-O-Level (SOL). An optimized sub-field weighting based on the mathematical Fibonacci sequence enables to fully respect the SOL criterion.

Figure 4:
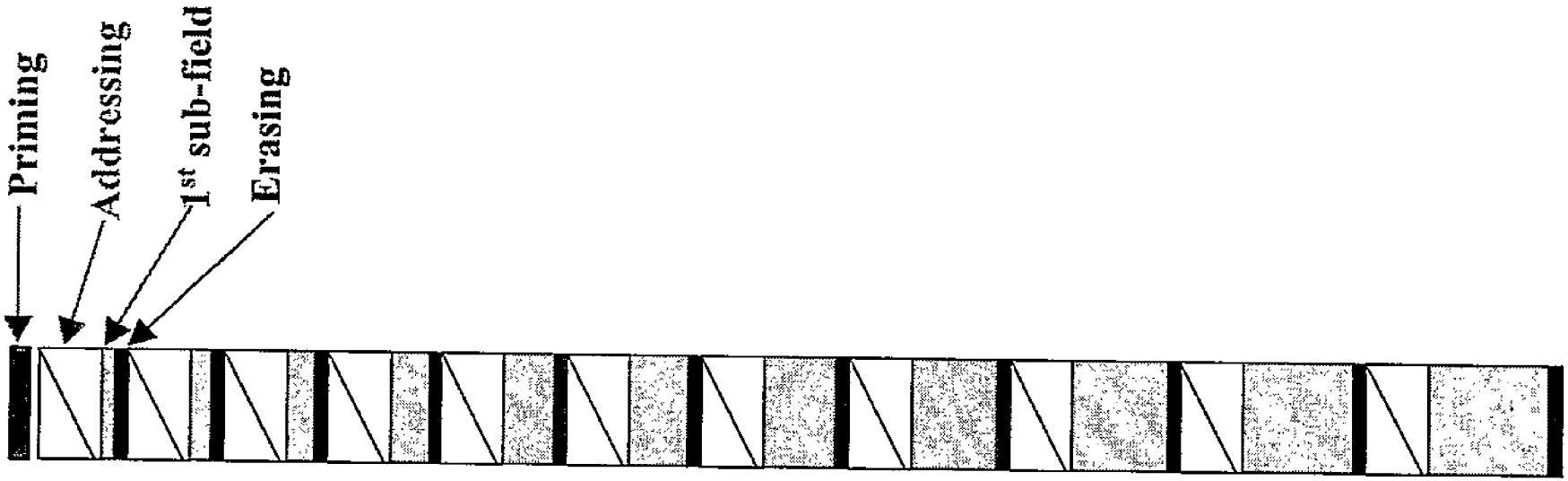

FIG. 4 illustrates an example of coding used for all further explanations (11 sub-field redundant coding). The frame depicted here starts with a priming operation. After that, a sequence of sub-fields follows. Each sub-field starts with an addressing block. According to the value of the sub-field a time period for applying sustain impulses follows. At the end of each sub-field a plasma cell is reset by an erasing operation.

Nevertheless, some experiments have shown that, under some circumstances, even a SOL criterion combined with a single "soft-priming" is not enough to provide perfect response fidelity.

Figure 5:
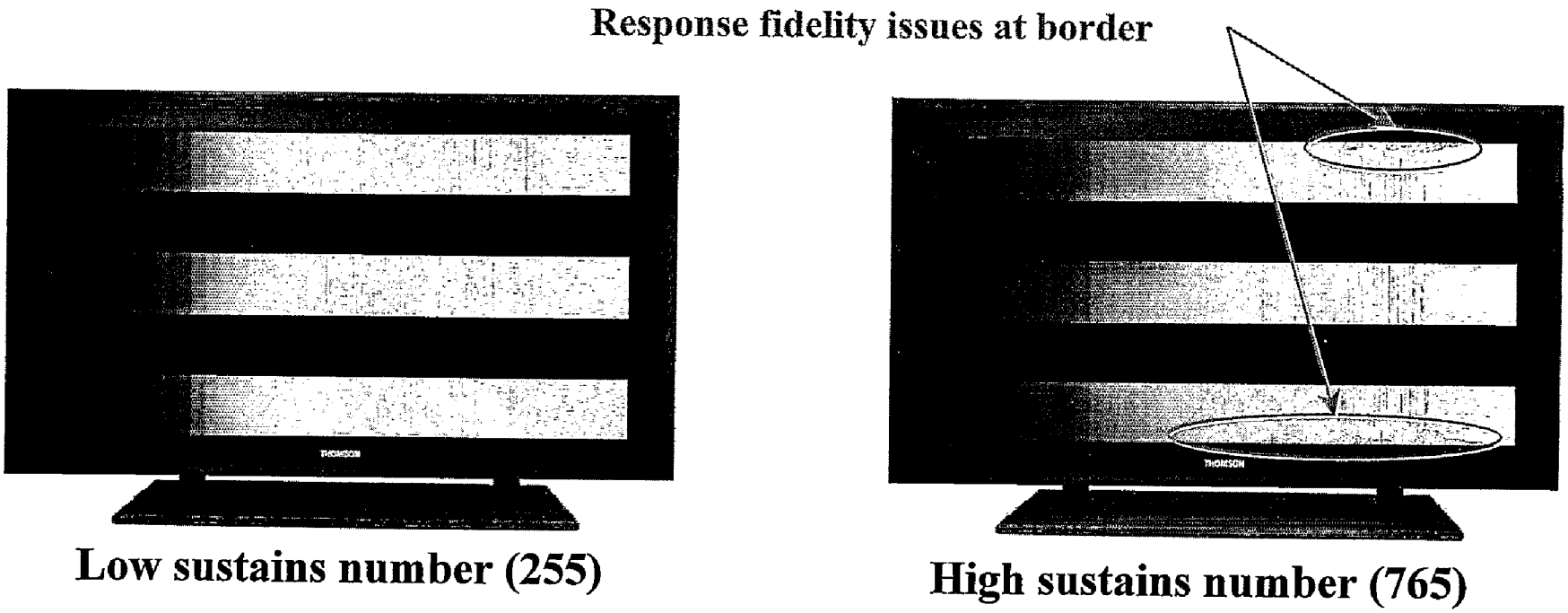

In the following the specific problem of the present invention is demonstrated. Experiments have shown that, when the number of sustains grows, the biggest sub-fields will suffer from response fidelity problems. These problems appear only under certain circumstances, for instance in the case of a horizontal greyscale at a high sustains number as shown in FIG. 5. When the number of sustains is increased, some response fidelity problems appear at the PDP borders. However, this does not appear in a homogeneous way but only some specific video levels are disturbed.

INVENTION

In view of that it is the object of the present invention to provide a method and device for processing video data, which remove the PDP border problem.

According to the present invention this object is solved by a method for processing video data to be displayed on a display screen by providing said video data having video levels selected from a predetermined number of video levels, encoding said predetermined number of video levels with a corresponding number of codewords and illuminating pixels in a central area of said display screen in accordance with said codewords, as well as illuminating pixels in a border area surrounding said central area of said display screen by using only those codewords of said number of codewords, which have a constant bit value in a selectable part of the codewords.

Furthermore, according to the present invention there is provided a device for processing video data to be displayed on a display screen including data providing means for providing said video data having video levels selected from a predetermined number of video levels, encoding means for encoding said predetermined number of video levels with a corresponding number of codewords and illuminating means for illuminating pixels in a central area of said display screen in accordance with said codewords, wherein said illuminating means is adapted for illuminating pixels in a border area surrounding said central area of said display screen by using only those codewords of said number of codewords, which have a constant bit value in a selectable part of the codewords.

Preferably, codewords, which have a binary 0 between two binary 1, are not used for illuminating the border area. Thus, cells of the display screen being ON cannot pollute surrounding cells being OFF.

Video levels corresponding to codewords being not used may be recreated by dithering. With such dithering every video level can be created by temporarily switching on an off a higher video level.

In a preferred embodiment a part of the codewords having constant bit value may be determined by a power level of a picture to be displayed. Since the pollution of neighbour cells depends on the power level of a picture, it is advantageous to adapt the coding of the video levels to the power level.

Moreover, the part of the codewords being determined to have constant bit value should include the most significant bits of the codewords. Thus, especially those codewords are not used for coding video levels, the high level sub-fields of which are on and off alternatingly. Consequently, cells of the display screen being energized by a lot of sustain impulses according to high level sub-fields will not pollute neighbouring cells being OFF.

The border problem is reduced towards the centre of the display screen. Therefore, the border area is preferably divided into several sub-areas, wherein the non-usage of codewords is stepwise reduced. A first one of said several sub-areas may be illuminated by codewords with a first selectable part of constant bit value and a second one of the several sub-areas may be illuminated by codewords with a second selectable part of constant bit value, wherein the second selectable part includes the first selectable part of codewords or at least a portion of it or is different from the first selectable part. In a preferred embodiment the length of the part within a codeword in which the bit value is constant, is variable starting from the most significant bit of a codeword.

DRAWINGS

Figure 6:
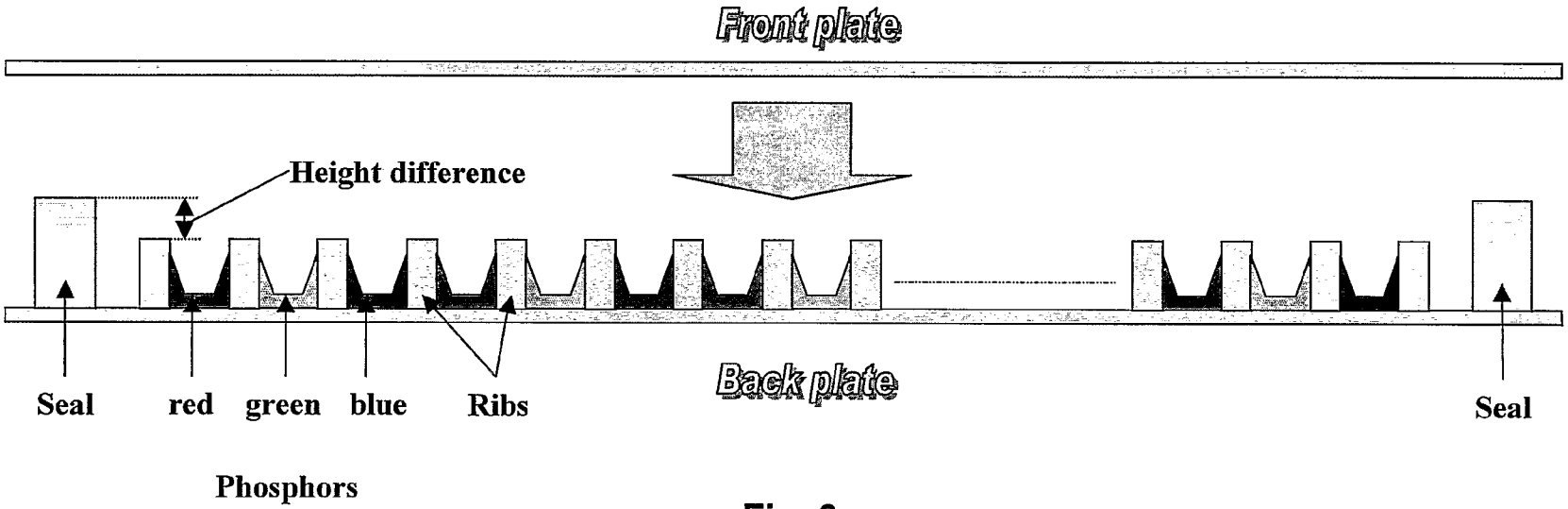
Figure 7:
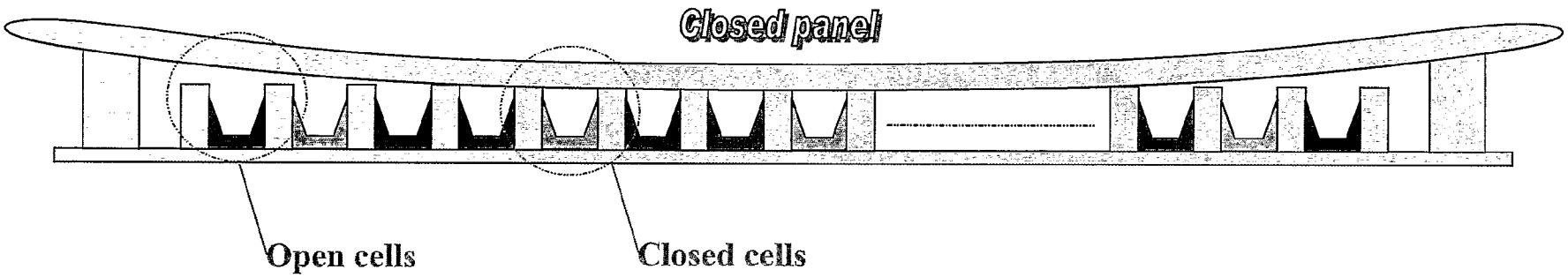
Figure 12:
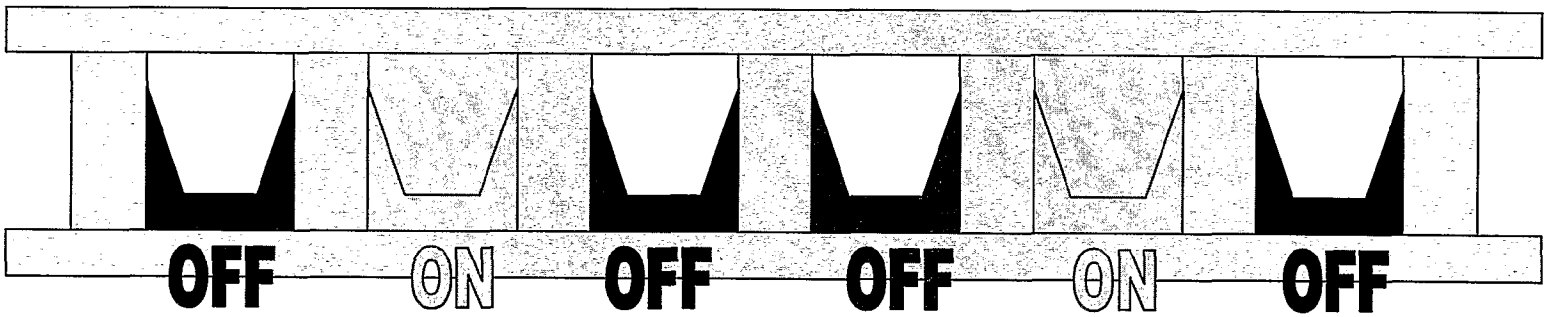
Figure 13:
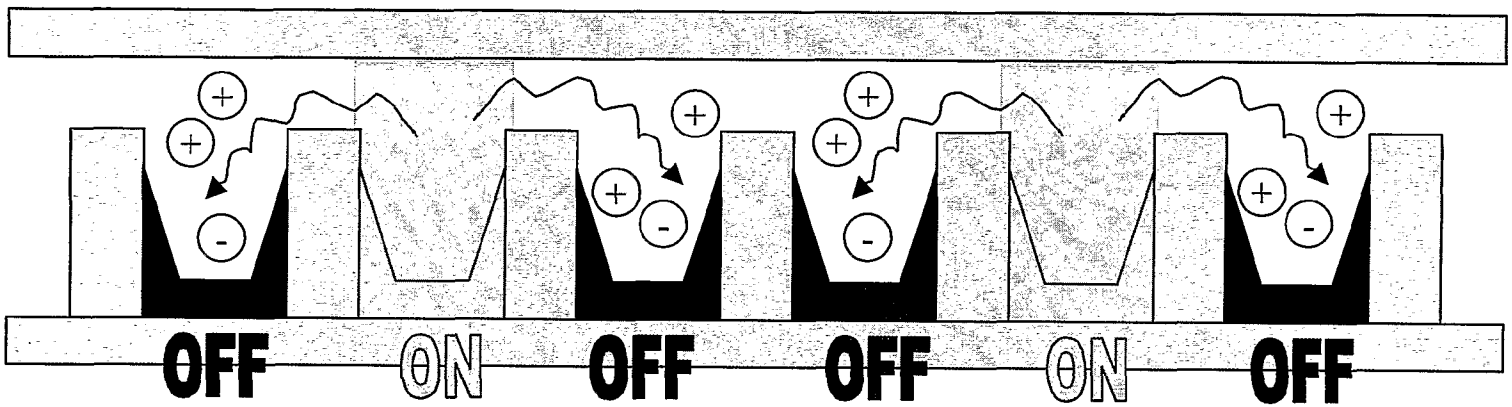
Figure 14:
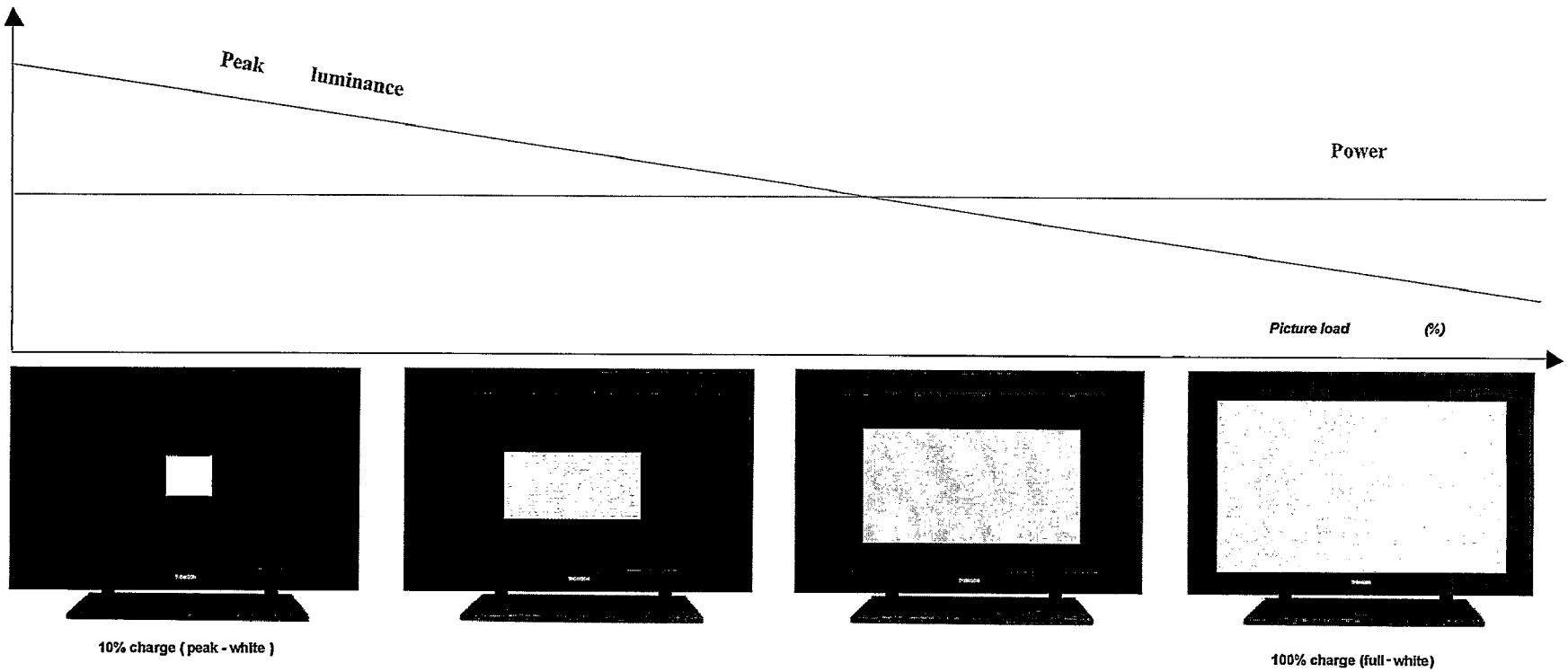
Figure 15:
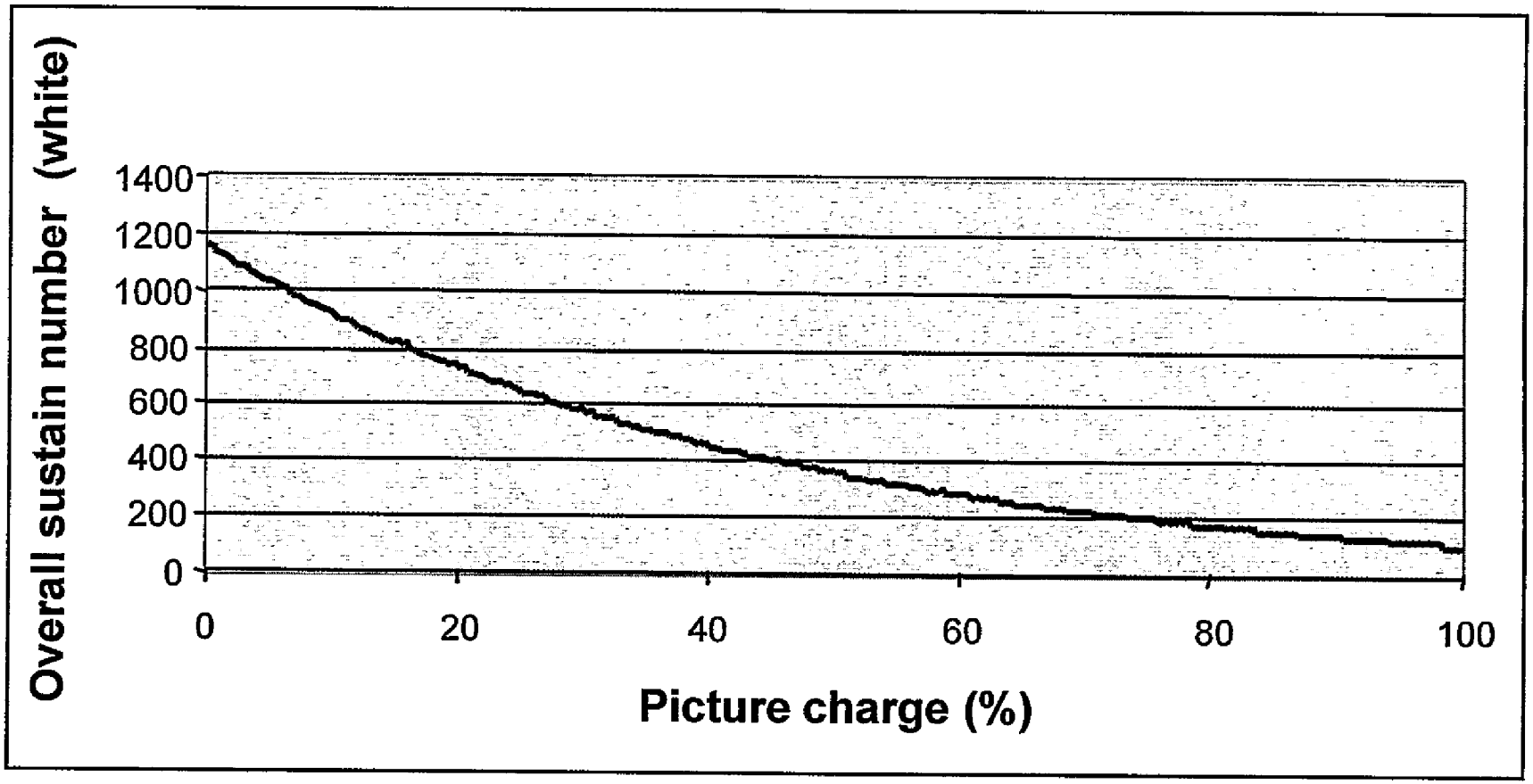
Figure 18:
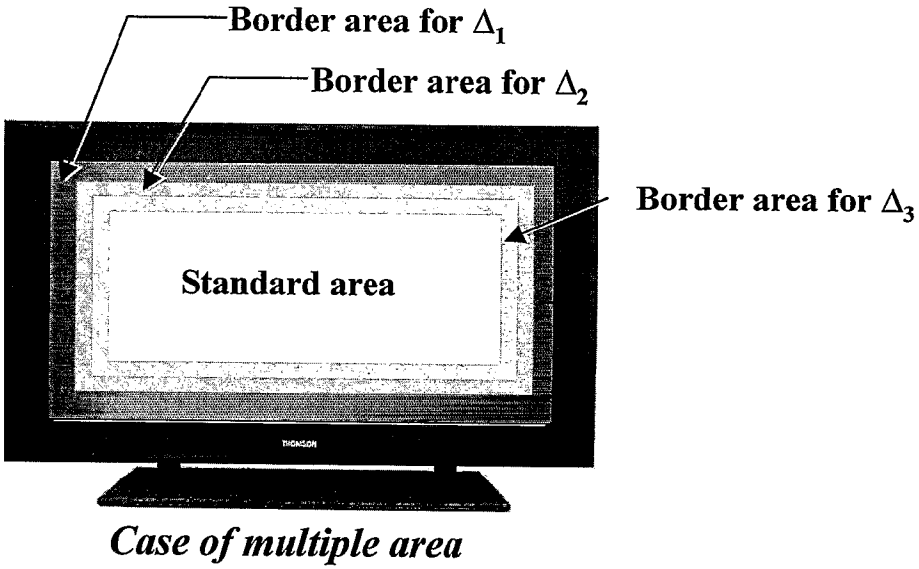
Figure 18:
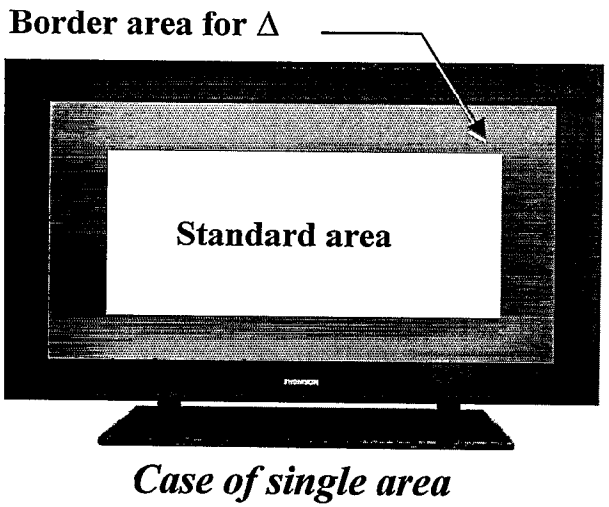

Exemplary embodiments of the invention are illustrated in the drawings and are explained in more detail in the following description. The drawings showing in:

FIG. 1 a dual-scan PDP having response fidelity problems;

FIG. 2 a cascade effect for last sub-field writing;

FIG. 3 various coding possibilities towards a single-0-concept;

FIG. 4 an example of the single soft-priming concept;

FIG. 5 a typical PDP border problem;

FIG. 6 the structure of a PDP before sealing;

FIG. 7 the structure of a PDP after sealing;

FIG. 8 a zoomed part of FIG. 5 having the border problem;

FIG. 9 a codeword comparison of the codewords of FIG. 8;

FIG. 10 a zoomed part of FIG. 5 having no border problems;

FIG. 11 a codeword comparison of codewords of FIG. 10;

FIG. 12 an ON/OFF pattern in case of closed cells of a display screen;

FIG. 13 an ON/OFF pattern in case of open cells of a display screen;

FIG. 14 a general concept of a power management;

FIG. 15 a function showing the linkage between the power consumption and the number of sustains per frame for a power management applied to a PDP;

FIG. 16 an evolution of sustain sequence versus the average power level;

FIG. 17 critical sub-field for response fidelity;

FIG. 18 display screens with different border areas; and

Figure 19:
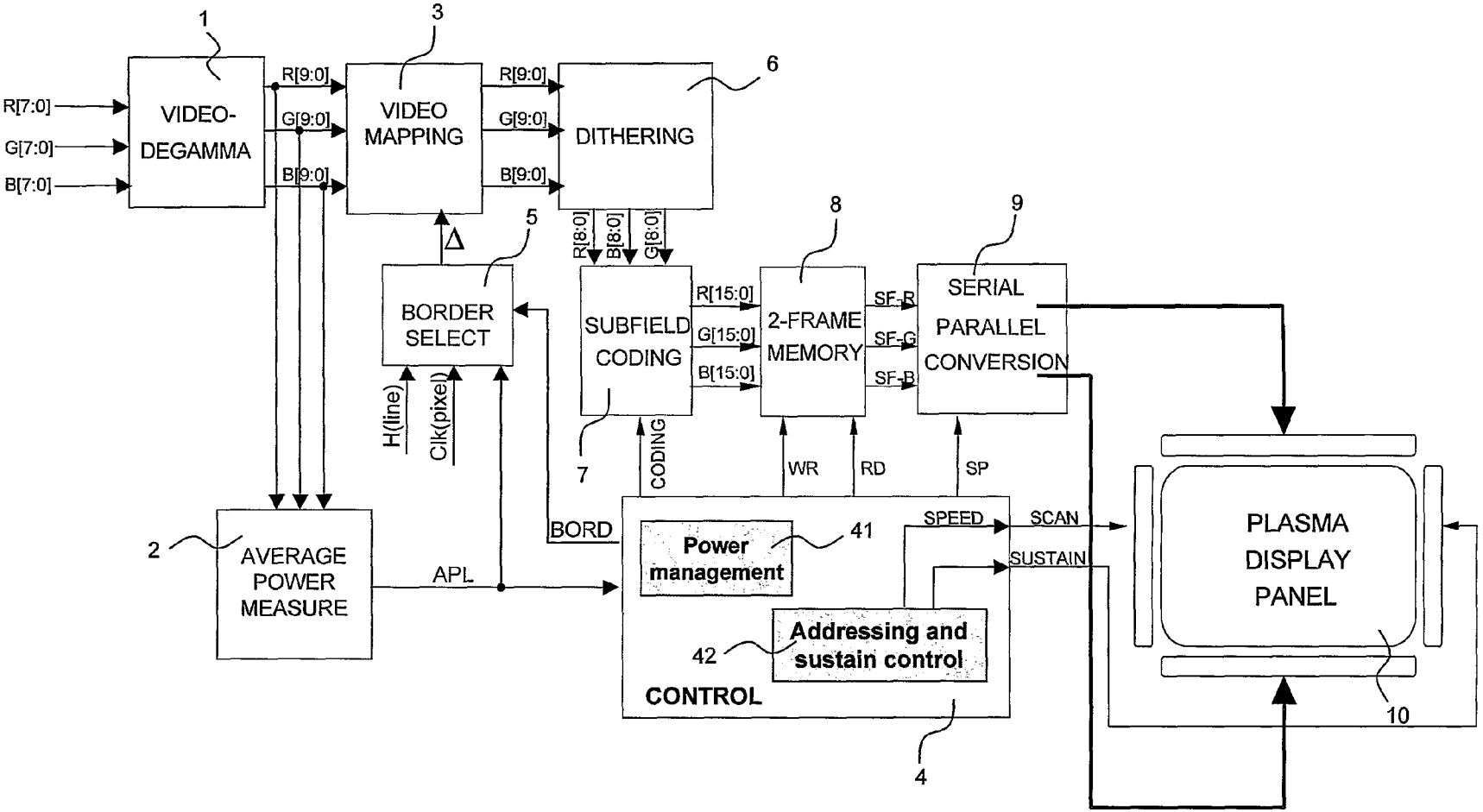

FIG. 19 a block diagram of a hardware implementation of a device according to the present invention.

EXEMPLARY EMBODIMENTS

The present invention is based on the knowledge that the structure of a PDP in its centre is different from that in the border area. In detail plasma panels are built with two glass plates (front and back) sealed together and having electrodes on top of them (horizontal transparent electrodes on the front plate, vertical metallic electrodes on the back plate). The various plasma cells (Red, Green and Blue dots) are delimited through so-called barrier-ribs having a certain height. This height also normally defines the distance between the two plates. This basic concept is illustrated in FIG. 6 for a PDP sealing. There is a height difference between the ribs and the seal being arranged at the border of the plasma panel. Indeed, in order to have a perfect sealing, it is needed that the seal is higher than the ribs. On the other side, the precision in this height is not very fine today and will also depend on the sealing process. Indeed, during that process, the seal will be molten. The result of the sealing process is shown in FIG. 7. In the middle of the screen (far from the seal) the cells are completely closed, whereas, at the border of the screen, near the seal, the cells are open.

This geometrical situation will have a strong impact on the panel response fidelity, above all for very energetic pictures (pictures with a lot of sustains).

In the introductory part the concept enabling the use of only one single priming operation in the case of an optimized encoding has been presented. This concept of single priming works very well in case of full-white pictures having a limited maximal white value (e.g. 100 cd./$m^2$ with around 150 sustains). In that case, since the soft-priming light emission is below 0.1 cd/$m^2$ the contrast ratio is beyond 1000:1 in dark room.

However, as illustrated in FIG. 5, when the number of sustain impulses grows, the biggest sub-field suffers from response fidelity problems e.g. in the case of a horizontal greyscale at the border of the PDP. In order to examine these response fidelity problems, a zoomed part of the screen is illustrated in FIG. 8. A greyscale is realized by a smooth transitation from the pixel value 170 to the pixel value 176 by displaying the values alternatingly. The following sub-field code is used:

1-2-3-5-8-12-18-24-31-40-50-61.

FIG. 8 shows that the response fidelity problems, in the example, are located at the cells having direct neighbours with different values. In other words, when a cell with the value 170 has a direct neighbour (not diagonal) having the value 176, both cells have problems.

In order to learn the reasons of the problems the sub-field codewords for these values should be compared. The comparison is shown in FIG. 9. Differences are given in the seventh and eighth bit.

Now, in order to learn more about the reason of the problems another zoomed part of the screen is shown in FIG. 10. As apparent from this Figure there are no cells having problems. A comparison of the codewords related to FIG. 10 is illustrated in FIG. 11. Differences appear in the second and third bit.

The examples given above show that the problem of response fidelity appearing at a PDP border for high video level pictures are linked to the switching ON/OFF of MSB. Indeed, in the case presented FIG. 8 showing artefacts, the differences between the video values 170 and 176 are located on the sub-fields 7 and 8. However, in the case presented in FIG. 10 showing no artefacts, the differences are located only in the LSBs.

This problem is directly linked to the situation described above: the open cells at the PDP border. Indeed, when an open cell has a certain sub-field switched ON, it will pollute the neighbouring cells that are OFF (compare FIG. 13). This is not the case for closed cells as immediately apparent from FIG. 12. The cells switched ON do not influence neighbouring cells switched OFF.

The examples above show that, when a cell is open, there could be a migration of charges to the neighbouring cells. When those neighbours are ON, the migration will disappear during a discharging operation. However, when the neighbouring cells are OFF, the charges will remain. The amount of charges will depend on the number of sustains used for the sub-field ON. Then, if the amount of polluting charges is strong enough, this could disturb the writing of the next sub-field for the polluted cells.

Up to a certain degree this pollution problem can be solved by applying priming operation, since the priming operation acts as reset and is able to suppress the polluting charges. In order to do that, this concept described in EP-A-1 335 341 is based on a limit Δ representing a maximal number of sustain without priming. In other words, when a sub-field contains more than Δ sustains, its priming is activated. This leads to an evolving number of priming. However, this also reduces the maximal available darkroom contrast.

In order to go further and to reduce the total amount of priming, according to the present invention it is suggested to modify the codeword at the panel border so that critical situations like that depicted in FIG. 5 can no more happen.

The codewords may be modified in dependence of the average power level of a picture to be displayed. A prerequisite of this is that an adequate power management is provided.

For every kind of active display, more peak luminance corresponds also to a higher power that flows in the electronic. Therefore, if no specific management is done, the enhancement of the peak luminance for a given electronic efficacy will introduce an increase of the power consumption. The main idea behind every kind of power management concept associated with peak white enhancement is based on the variation of the peak-luminance depending on the picture content in order to stabilize the power consumption to a specified value. This is illustrated in FIG. 14. The concept enables to avoid any overloading of the power-supply as well as a maximum contrast for a given picture. In the case of analogue displays like CRTs, the power management is based on a so called ABM function (Average Beam-current Limiter), which is implemented by analogue means, and which decreases video gain as a function of average luminance, usually measured over a RC stage. In the case of a plasma display, the luminance, i.e. the picture charge, as well as the power consumption is directly linked to the number of sustains (light pulse) per frame as shown in FIG. 15.

In order to avoid overloading the power supply of the plasma, the number of sustains can be adjusted depending on the picture content. When the picture is full (e.g. full white page—100%) it is not possible to use the total amount of sustains (e.g. only 100 sustains are used) which leads to a reduced white luminance (around 100 cd/m2). This determines the power consumption (e.g. 300 W). Then when the charge of the picture decreases (e.g. night with only a small moon up to 0%), the number of sustains can be increased without increasing the power consumption. This only enhances the contrast for the human eye.

In other words, for every charge of the input picture computed through the APL (Average Power Level), a certain amount of sustain impulses will be used for the peak white as shown in FIG. 15. This has the disadvantage of allowing only a reduced number of discrete power levels compared to an analogue system. The computation of the image energy (APL) is made through the following function:

$$APL(I(x, y)) = \frac{1}{C \times L} \cdot \sum_{x,y} I(x, y)$$

where I(x,y) represents the picture to be displayed, C the number of columns and L the number of lines of this picture. Then, for every possible APL values, the maximal number of sustains to be used is fixed.

Since, only an integer number of sustains can be used, there is only a limited number of available APL levels. This is illustrated in FIG. 16 representing the sustain sequences for various APL levels at a given sub-fields sequence based on a 12 sub-fields Fibonacci sequence: 1-2-3-5-8-13-19-25-32-40-49-58

According to FIG. 15 the number of sustains for a given sub-field is changing a lot. If one considers the case of a limit value Δ=55 of sustains under which there is no polluting problem, one can easily detect the sub-fields showing critical behaviour as shown in FIG. 17. The sub-fields showing response fidelity problems are marked with grey colour. In the case of EP-A-1 335 341, these sub-fields represent the sub-fields, which would be primed. However, according to the present new concept, the codewords related to these sub-fields will be modified (depending on the APL situation). Obviously, this codeword modification will only be performed on the sub-fields showing problems at the moment where a modification is needed: there is no need to make any modification for APL=100% whereas seven sub-fields could be affected for APL=0%.

An other important aspect of the present new concept of codeword modification is its compatibility with the previous concept of dynamic priming. Indeed, both concepts can be utilized separately but a combination of both brings further improvements. On one hand, dynamic priming increases the dark level (reducing the darkroom contrast) without modifying the greyscale quality, on the other hand the concept of codeword modification limits the greyscale portrayal capability of the plasma panel in border areas while requiring no additional priming.

As already said, the inventive concept is based on a specific encoding for border areas. FIG. 18 illustrates the concept of border areas surrounding a standard area with two possibilities:

- Only one border area is used having a single limit Δ used for the codeword limitation (left side of FIG. 18).
- Multiple border areas are defined, each of them having their independent limit Δ1,Δ2,Δ3 with Δ1<Δ2<Δ3 since the polluting level is reducing while moving away from the screen border (right side of FIG. 18).

It is important to notice here that the border areas are really small and do not represent a main part of the screen (e.g. only 4% of the screen).

In the following the basic concept of codeword limitation shall be explained in detail. For this, the example defined in FIG. 16 for the case of APL=0% and for the three limits Δ1, Δ2, Δ3 in case of multiple border areas will be utilized. The following limit values are chosen.

Δ1=55

Δ2=90

Δ3=120

In fact, the values are obtained through measurements at the panel level.

The main idea behind this concept is to forbid the insertion of 0 between two 1 for critical sub-fields. In other words, in the total amount of existing codewords, the critical ones will be suppressed. In the following table one can find the standard encoding table for the sub-field sequences used above: 1-2-3-5-8-13-19-25-32-40-49-58 as well as the suppressed codewords for all areas.

TABLE

Coding of three border areas

| Video value | Codeword standard | Codeword for $\Delta_3$ | Codeword for $\Delta_2$ | Codeword for $\Delta_1$ |
|---|---|---|---|---|
| 0 | 000000000000 | 000000000000 | 000000000000 | 000000000000 |
| 1 | 100000000000 | 100000000000 | 100000000000 | 100000000000 |
| 2 | 010000000000 | 010000000000 | 010000000000 | 010000000000 |
| 3 | 110000000000 | 110000000000 | 110000000000 | 110000000000 |
| 4 | 101000000000 | 101000000000 | 101000000000 | 101000000000 |
| 5 | 011000000000 | 011000000000 | 011000000000 | 011000000000 |
| 6 | 111000000000 | 111000000000 | 111000000000 | 111000000000 |
| 7 | 010100000000 | 010100000000 | 010100000000 | 010100000000 |
| 8 | 110100000000 | 110100000000 | 110100000000 | 110100000000 |
| 9 | 101100000000 | 101100000000 | 101100000000 | 101100000000 |
| 10 | 011100000000 | 011100000000 | 011100000000 | 011100000000 |
| 11 | 111100000000 | 111100000000 | 111100000000 | 111100000000 |
| 12 | 101010000000 | 101010000000 | 101010000000 | 101010000000 |
| 13 | 011010000000 | 011010000000 | 011010000000 | 011010000000 |
| 14 | 111010000000 | 111010000000 | 111010000000 | 111010000000 |
| 15 | 010110000000 | 010110000000 | 010110000000 | 010110000000 |
| 16 | 110110000000 | 110110000000 | 110110000000 | 110110000000 |
| 17 | 101110000000 | 101110000000 | 101110000000 | 101110000000 |
| 18 | 011110000000 | 011110000000 | 011110000000 | 011110000000 |
| 19 | 111110000000 | 111110000000 | 111110000000 | 111110000000 |
| 20 | 010101000000 | 010101000000 | 010101000000 | 010101000000 |
| 21 | 110101000000 | 110101000000 | 110101000000 | 110101000000 |
| 22 | 101101000000 | 101101000000 | 101101000000 | 101101000000 |
| 23 | 011101000000 | 011101000000 | 011101000000 | 011101000000 |
| 24 | 111101000000 | 111101000000 | 111101000000 | 111101000000 |
| 25 | 101011000000 | 101011000000 | 101011000000 | 101011000000 |
| 26 | 011011000000 | 011011000000 | 011011000000 | 011011000000 |

TABLE-continued

| Coding of three border areas | | | | |
|---|---|---|---|---|
| Video value | Codeword standard | Codeword for $\Delta_3$ | Codeword for $\Delta_2$ | Codeword for $\Delta_1$ |
| 27 | 111011000000 | 111011000000 | 111011000000 | 111011000000 |
| 28 | 010111000000 | 010111000000 | 010111000000 | 010111000000 |
| 29 | 110111000000 | 110111000000 | 110111000000 | 110111000000 |
| 30 | 101111000000 | 101111000000 | 101111000000 | 101111000000 |
| 31 | 011111000000 | 011111000000 | 011111000000 | 011111000000 |
| 32 | 111111000000 | 111111000000 | 111111000000 | 111111000000 |
| 33 | 111010100000 | 111010100000 | 111010100000 | XXXXXXXXXXXX |
| 34 | 010110100000 | 010110100000 | 010110100000 | XXXXXXXXXXXX |
| 35 | 110110100000 | 110110100000 | 110110100000 | XXXXXXXXXXXX |
| 36 | 101110100000 | 101110100000 | 101110100000 | XXXXXXXXXXXX |
| 37 | 011110100000 | 011110100000 | 011110100000 | XXXXXXXXXXXX |
| 38 | 111110100000 | 111110100000 | 111110100000 | XXXXXXXXXXXX |
| 39 | 010101100000 | 010101100000 | 010101100000 | 010101100000 |
| 40 | 110101100000 | 110101100000 | 110101100000 | 110101100000 |
| 41 | 101101100000 | 101101100000 | 101101100000 | 101101100000 |
| 42 | 011101100000 | 011101100000 | 011101100000 | 011101100000 |
| 43 | 111101100000 | 111101100000 | 111101100000 | 111101100000 |
| 44 | 101011100000 | 101011100000 | 101011100000 | 101011100000 |
| 45 | 011011100000 | 011011100000 | 011011100000 | 011011100000 |
| 46 | 111011100000 | 111011100000 | 111011100000 | 111011100000 |
| 47 | 010111100000 | 010111100000 | 010111100000 | 010111100000 |
| 48 | 110111100000 | 110111100000 | 110111100000 | 110111100000 |
| 49 | 101111100000 | 101111100000 | 101111100000 | 101111100000 |
| 50 | 011111100000 | 011111100000 | 011111100000 | 011111100000 |
| 51 | 111111100000 | 111111100000 | 111111100000 | 111111100000 |
| 52 | 111011010000 | 111011010000 | XXXXXXXXXXXX | XXXXXXXXXXXX |
| 53 | 010111010000 | 010111010000 | XXXXXXXXXXXX | XXXXXXXXXXXX |
| 54 | 110111010000 | 110111010000 | XXXXXXXXXXXX | XXXXXXXXXXXX |
| 55 | 101111010000 | 101111010000 | XXXXXXXXXXXX | XXXXXXXXXXXX |
| 56 | 011111010000 | 011111010000 | XXXXXXXXXXXX | XXXXXXXXXXXX |
| 57 | 111111010000 | 111111010000 | XXXXXXXXXXXX | XXXXXXXXXXXX |
| 58 | 111010110000 | 111010110000 | 111010110000 | XXXXXXXXXXXX |
| 59 | 010110110000 | 010110110000 | 010110110000 | XXXXXXXXXXXX |
| 60 | 110110110000 | 110110110000 | 110110110000 | XXXXXXXXXXXX |
| 61 | 101110110000 | 101110110000 | 101110110000 | XXXXXXXXXXXX |
| 62 | 011110110000 | 011110110000 | 011110110000 | XXXXXXXXXXXX |
| 63 | 111110110000 | 111110110000 | 111110110000 | XXXXXXXXXXXX |
| 64 | 010101110000 | 010101110000 | 010101110000 | 010101110000 |
| 65 | 110101110000 | 110101110000 | 110101110000 | 110101110000 |
| 66 | 101101110000 | 101101110000 | 101101110000 | 101101110000 |
| 67 | 011101110000 | 011101110000 | 011101110000 | 011101110000 |
| 68 | 111101110000 | 111101110000 | 111101110000 | 111101110000 |
| 69 | 101011110000 | 101011110000 | 101011110000 | 101011110000 |
| 70 | 011011110000 | 011011110000 | 011011110000 | 011011110000 |
| 71 | 111011110000 | 111011110000 | 111011110000 | 111011110000 |
| 72 | 010111110000 | 010111110000 | 010111110000 | 010111110000 |
| 73 | 110111110000 | 110111110000 | 110111110000 | 110111110000 |
| 74 | 101111110000 | 101111110000 | 101111110000 | 101111110000 |
| 75 | 011111110000 | 011111110000 | 011111110000 | 011111110000 |
| 76 | 111111110000 | 111111110000 | 111111110000 | 111111110000 |
| 77 | 011011101000 | XXXXXXXXXXXX | XXXXXXXXXXXX | XXXXXXXXXXXX |
| 78 | 111011101000 | XXXXXXXXXXXX | XXXXXXXXXXXX | XXXXXXXXXXXX |
| 79 | 010111101000 | XXXXXXXXXXXX | XXXXXXXXXXXX | XXXXXXXXXXXX |
| 80 | 110111101000 | XXXXXXXXXXXX | XXXXXXXXXXXX | XXXXXXXXXXXX |
| 81 | 101111101000 | XXXXXXXXXXXX | XXXXXXXXXXXX | XXXXXXXXXXXX |
| 82 | 011111101000 | XXXXXXXXXXXX | XXXXXXXXXXXX | XXXXXXXXXXXX |
| 83 | 111111101000 | XXXXXXXXXXXX | XXXXXXXXXXXX | XXXXXXXXXXXX |
| 84 | 111011011000 | 111011011000 | XXXXXXXXXXXX | XXXXXXXXXXXX |
| 85 | 010111011000 | 010111011000 | XXXXXXXXXXXX | XXXXXXXXXXXX |
| 86 | 110111011000 | 110111011000 | XXXXXXXXXXXX | XXXXXXXXXXXX |
| 87 | 101111011000 | 101111011000 | XXXXXXXXXXXX | XXXXXXXXXXXX |
| 88 | 011111011000 | 011111011000 | XXXXXXXXXXXX | XXXXXXXXXXXX |
| 89 | 111111011000 | 111111011000 | XXXXXXXXXXXX | XXXXXXXXXXXX |
| 90 | 111010111000 | 111010111000 | 111010111000 | XXXXXXXXXXXX |
| 91 | 010110111000 | 010110111000 | 010110111000 | XXXXXXXXXXXX |
| 92 | 110110111000 | 110110111000 | 110110111000 | XXXXXXXXXXXX |
| 93 | 101110111000 | 101110111000 | 101110111000 | XXXXXXXXXXXX |
| 94 | 011110111000 | 011110111000 | 011110111000 | XXXXXXXXXXXX |
| 95 | 111110111000 | 111110111000 | 111110111000 | XXXXXXXXXXXX |
| 96 | 010101111000 | 010101111000 | 010101111000 | 010101111000 |
| 97 | 110101111000 | 110101111000 | 110101111000 | 110101111000 |
| 98 | 101101111000 | 101101111000 | 101101111000 | 101101111000 |
| 99 | 011101111000 | 011101111000 | 011101111000 | 011101111000 |
| 100 | 111101111000 | 111101111000 | 111101111000 | 111101111000 |

TABLE-continued

| Coding of three border areas | | | | |
|---|---|---|---|---|
| Video value | Codeword standard | Codeword for $\Delta_3$ | Codeword for $\Delta_2$ | Codeword for $\Delta_1$ |
| 101 | 101011111000 | 101011111000 | 101011111000 | 101011111000 |
| 102 | 011011111000 | 011011111000 | 011011111000 | 011011111000 |
| 103 | 111011111000 | 111011111000 | 111011111000 | 111011111000 |
| 104 | 010111111000 | 010111111000 | 010111111000 | 010111111000 |
| 105 | 110111111000 | 110111111000 | 110111111000 | 110111111000 |
| 106 | 101111111000 | 101111111000 | 101111111000 | 101111111000 |
| 107 | 011111111000 | 011111111000 | 011111111000 | 011111111000 |
| 108 | 111111111000 | 111111111000 | 111111111000 | 111111111000 |
| 109 | 101011110100 | XXXXXXXXXXXX | XXXXXXXXXXXX | XXXXXXXXXXXX |
| 110 | 011011110100 | XXXXXXXXXXXX | XXXXXXXXXXXX | XXXXXXXXXXXX |
| 111 | 111011110100 | XXXXXXXXXXXX | XXXXXXXXXXXX | XXXXXXXXXXXX |
| 112 | 010111110100 | XXXXXXXXXXXX | XXXXXXXXXXXX | XXXXXXXXXXXX |
| 113 | 110111110100 | XXXXXXXXXXXX | XXXXXXXXXXXX | XXXXXXXXXXXX |
| 114 | 101111110100 | XXXXXXXXXXXX | XXXXXXXXXXXX | XXXXXXXXXXXX |
| 115 | 011111110100 | XXXXXXXXXXXX | XXXXXXXXXXXX | XXXXXXXXXXXX |
| 116 | 111111110100 | XXXXXXXXXXXX | XXXXXXXXXXXX | XXXXXXXXXXXX |
| 117 | 011011101100 | XXXXXXXXXXXX | XXXXXXXXXXXX | XXXXXXXXXXXX |
| 118 | 111011101100 | XXXXXXXXXXXX | XXXXXXXXXXXX | XXXXXXXXXXXX |
| 119 | 010111101100 | XXXXXXXXXXXX | XXXXXXXXXXXX | XXXXXXXXXXXX |
| 120 | 110111101100 | XXXXXXXXXXXX | XXXXXXXXXXXX | XXXXXXXXXXXX |
| 121 | 101111101100 | XXXXXXXXXXXX | XXXXXXXXXXXX | XXXXXXXXXXXX |
| 122 | 011111101100 | XXXXXXXXXXXX | XXXXXXXXXXXX | XXXXXXXXXXXX |
| 123 | 111111101100 | XXXXXXXXXXXX | XXXXXXXXXXXX | XXXXXXXXXXXX |
| 124 | 111011011100 | 111011011100 | XXXXXXXXXXXX | XXXXXXXXXXXX |
| 125 | 010111011100 | 010111011100 | XXXXXXXXXXXX | XXXXXXXXXXXX |
| 126 | 110111011100 | 110111011100 | XXXXXXXXXXXX | XXXXXXXXXXXX |
| 127 | 101111011100 | 101111011100 | XXXXXXXXXXXX | XXXXXXXXXXXX |
| 128 | 011111011100 | 011111011100 | XXXXXXXXXXXX | XXXXXXXXXXXX |
| 129 | 111111011100 | 111111011100 | XXXXXXXXXXXX | XXXXXXXXXXXX |
| 130 | 111010111100 | 111010111100 | 111010111100 | XXXXXXXXXXXX |
| 131 | 010110111100 | 010110111100 | 010110111100 | XXXXXXXXXXXX |
| 132 | 110110111100 | 110110111100 | 110110111100 | XXXXXXXXXXXX |
| 133 | 101110111100 | 101110111100 | 101110111100 | XXXXXXXXXXXX |
| 134 | 011110111100 | 011110111100 | 011110111100 | XXXXXXXXXXXX |
| 135 | 111110111100 | 111110111100 | 111110111100 | XXXXXXXXXXXX |
| 136 | 010101111100 | 010101111100 | 010101111100 | 010101111100 |
| 137 | 110101111100 | 110101111100 | 110101111100 | 110101111100 |
| 138 | 101101111100 | 101101111100 | 101101111100 | 101101111100 |
| 139 | 011101111100 | 011101111100 | 011101111100 | 011101111100 |
| 140 | 111101111100 | 111101111100 | 111101111100 | 111101111100 |
| 141 | 101011111100 | 101011111100 | 101011111100 | 101011111100 |
| 142 | 011011111100 | 011011111100 | 011011111100 | 011011111100 |
| 143 | 111011111100 | 111011111100 | 111011111100 | 111011111100 |
| 144 | 010111111100 | 010111111100 | 010111111100 | 010111111100 |
| 145 | 110111111100 | 110111111100 | 110111111100 | 110111111100 |
| 146 | 101111111100 | 101111111100 | 101111111100 | 101111111100 |
| 147 | 011111111100 | 011111111100 | 011111111100 | 011111111100 |
| 148 | 111111111100 | 111111111100 | 111111111100 | 111111111100 |
| 149 | 111101111010 | XXXXXXXXXXXX | XXXXXXXXXXXX | XXXXXXXXXXXX |
| 150 | 101011111010 | XXXXXXXXXXXX | XXXXXXXXXXXX | XXXXXXXXXXXX |
| 151 | 011011111010 | XXXXXXXXXXXX | XXXXXXXXXXXX | XXXXXXXXXXXX |
| 152 | 111011111010 | XXXXXXXXXXXX | XXXXXXXXXXXX | XXXXXXXXXXXX |
| 153 | 010111111010 | XXXXXXXXXXXX | XXXXXXXXXXXX | XXXXXXXXXXXX |
| 154 | 110111111010 | XXXXXXXXXXXX | XXXXXXXXXXXX | XXXXXXXXXXXX |
| 155 | 101111111010 | XXXXXXXXXXXX | XXXXXXXXXXXX | XXXXXXXXXXXX |
| 156 | 011111111010 | XXXXXXXXXXXX | XXXXXXXXXXXX | XXXXXXXXXXXX |
| 157 | 111111111010 | XXXXXXXXXXXX | XXXXXXXXXXXX | XXXXXXXXXXXX |
| 158 | 101011110110 | XXXXXXXXXXXX | XXXXXXXXXXXX | XXXXXXXXXXXX |
| 159 | 011011110110 | XXXXXXXXXXXX | XXXXXXXXXXXX | XXXXXXXXXXXX |
| 160 | 111011110110 | XXXXXXXXXXXX | XXXXXXXXXXXX | XXXXXXXXXXXX |
| 161 | 010111110110 | XXXXXXXXXXXX | XXXXXXXXXXXX | XXXXXXXXXXXX |
| 162 | 110111110110 | XXXXXXXXXXXX | XXXXXXXXXXXX | XXXXXXXXXXXX |
| 163 | 101111110110 | XXXXXXXXXXXX | XXXXXXXXXXXX | XXXXXXXXXXXX |
| 164 | 011111110110 | XXXXXXXXXXXX | XXXXXXXXXXXX | XXXXXXXXXXXX |
| 165 | 111111110110 | XXXXXXXXXXXX | XXXXXXXXXXXX | XXXXXXXXXXXX |
| 166 | 011011101110 | XXXXXXXXXXXX | XXXXXXXXXXXX | XXXXXXXXXXXX |
| 167 | 111011101110 | XXXXXXXXXXXX | XXXXXXXXXXXX | XXXXXXXXXXXX |
| 168 | 010111101110 | XXXXXXXXXXXX | XXXXXXXXXXXX | XXXXXXXXXXXX |
| 169 | 110111101110 | XXXXXXXXXXXX | XXXXXXXXXXXX | XXXXXXXXXXXX |
| 170 | 101111101110 | XXXXXXXXXXXX | XXXXXXXXXXXX | XXXXXXXXXXXX |
| 171 | 011111101110 | XXXXXXXXXXXX | XXXXXXXXXXXX | XXXXXXXXXXXX |
| 172 | 111111101110 | XXXXXXXXXXXX | XXXXXXXXXXXX | XXXXXXXXXXXX |
| 173 | 111011011110 | 111011011110 | XXXXXXXXXXXX | XXXXXXXXXXXX |
| 174 | 010111011110 | 010111011110 | XXXXXXXXXXXX | XXXXXXXXXXXX |

TABLE-continued

| Coding of three border areas | | | | |
|---|---|---|---|---|
| Video value | Codeword standard | Codeword for $\Delta_3$ | Codeword for $\Delta_2$ | Codeword for $\Delta_1$ |
| 175 | 110111011110 | 110111011110 | XXXXXXXXXXXX | XXXXXXXXXXXX |
| 176 | 101111011110 | 101111011110 | XXXXXXXXXXXX | XXXXXXXXXXXX |
| 177 | 011111011110 | 011111011110 | XXXXXXXXXXXX | XXXXXXXXXXXX |
| 178 | 111111011110 | 111111011110 | XXXXXXXXXXXX | XXXXXXXXXXXX |
| 179 | 111010111110 | 111010111110 | 111010111110 | XXXXXXXXXXXX |
| 180 | 010110111110 | 010110111110 | 010110111110 | XXXXXXXXXXXX |
| 181 | 110110111110 | 110110111110 | 110110111110 | XXXXXXXXXXXX |
| 182 | 101110111110 | 101110111110 | 101110111110 | XXXXXXXXXXXX |
| 183 | 011110111110 | 011110111110 | 011110111110 | XXXXXXXXXXXX |
| 184 | 111110111110 | 111110111110 | 111110111110 | XXXXXXXXXXXX |
| 185 | 010101111110 | 010101111110 | 010101111110 | 010101111110 |
| 186 | 110101111110 | 110101111110 | 110101111110 | 110101111110 |
| 187 | 101101111110 | 101101111110 | 101101111110 | 101101111110 |
| 188 | 011101111110 | 011101111110 | 011101111110 | 011101111110 |
| 189 | 111101111110 | 111101111110 | 111101111110 | 111101111110 |
| 190 | 101011111110 | 101011111110 | 101011111110 | 101011111110 |
| 191 | 011011111110 | 011011111110 | 011011111110 | 011011111110 |
| 192 | 111011111110 | 111011111110 | 111011111110 | 111011111110 |
| 193 | 010111111110 | 010111111110 | 010111111110 | 010111111110 |
| 194 | 110111111110 | 110111111110 | 110111111110 | 110111111110 |
| 195 | 101111111110 | 101111111110 | 101111111110 | 101111111110 |
| 196 | 011111111110 | 011111111110 | 011111111110 | 011111111110 |
| 197 | 111111111110 | 111111111110 | 111111111110 | 111111111110 |
| 198 | 111101111101 | XXXXXXXXXXXX | XXXXXXXXXXXX | XXXXXXXXXXXX |
| 199 | 101011111101 | XXXXXXXXXXXX | XXXXXXXXXXXX | XXXXXXXXXXXX |
| 200 | 011011111101 | XXXXXXXXXXXX | XXXXXXXXXXXX | XXXXXXXXXXXX |
| 201 | 111011111101 | XXXXXXXXXXXX | XXXXXXXXXXXX | XXXXXXXXXXXX |
| 202 | 010111111101 | XXXXXXXXXXXX | XXXXXXXXXXXX | XXXXXXXXXXXX |
| 203 | 110111111101 | XXXXXXXXXXXX | XXXXXXXXXXXX | XXXXXXXXXXXX |
| 204 | 101111111101 | XXXXXXXXXXXX | XXXXXXXXXXXX | XXXXXXXXXXXX |
| 205 | 011111111101 | XXXXXXXXXXXX | XXXXXXXXXXXX | XXXXXXXXXXXX |
| 206 | 111111111101 | XXXXXXXXXXXX | XXXXXXXXXXXX | XXXXXXXXXXXX |
| 207 | 111101111011 | XXXXXXXXXXXX | XXXXXXXXXXXX | XXXXXXXXXXXX |
| 208 | 101011111011 | XXXXXXXXXXXX | XXXXXXXXXXXX | XXXXXXXXXXXX |
| 209 | 011011111011 | XXXXXXXXXXXX | XXXXXXXXXXXX | XXXXXXXXXXXX |
| 210 | 111011111011 | XXXXXXXXXXXX | XXXXXXXXXXXX | XXXXXXXXXXXX |
| 211 | 010111111011 | XXXXXXXXXXXX | XXXXXXXXXXXX | XXXXXXXXXXXX |
| 212 | 110111111011 | XXXXXXXXXXXX | XXXXXXXXXXXX | XXXXXXXXXXXX |
| 213 | 101111111011 | XXXXXXXXXXXX | XXXXXXXXXXXX | XXXXXXXXXXXX |
| 214 | 011111111011 | XXXXXXXXXXXX | XXXXXXXXXXXX | XXXXXXXXXXXX |
| 215 | 111111111011 | XXXXXXXXXXXX | XXXXXXXXXXXX | XXXXXXXXXXXX |
| 216 | 101011110111 | XXXXXXXXXXXX | XXXXXXXXXXXX | XXXXXXXXXXXX |
| 217 | 011011110111 | XXXXXXXXXXXX | XXXXXXXXXXXX | XXXXXXXXXXXX |
| 218 | 111011110111 | XXXXXXXXXXXX | XXXXXXXXXXXX | XXXXXXXXXXXX |
| 219 | 010111110111 | XXXXXXXXXXXX | XXXXXXXXXXXX | XXXXXXXXXXXX |
| 220 | 110111110111 | XXXXXXXXXXXX | XXXXXXXXXXXX | XXXXXXXXXXXX |
| 221 | 101111110111 | XXXXXXXXXXXX | XXXXXXXXXXXX | XXXXXXXXXXXX |
| 222 | 011111110111 | XXXXXXXXXXXX | XXXXXXXXXXXX | XXXXXXXXXXXX |
| 223 | 111111110111 | XXXXXXXXXXXX | XXXXXXXXXXXX | XXXXXXXXXXXX |
| 224 | 011011101111 | XXXXXXXXXXXX | XXXXXXXXXXXX | XXXXXXXXXXXX |
| 225 | 111011101111 | XXXXXXXXXXXX | XXXXXXXXXXXX | XXXXXXXXXXXX |
| 226 | 010111101111 | XXXXXXXXXXXX | XXXXXXXXXXXX | XXXXXXXXXXXX |
| 227 | 110111101111 | XXXXXXXXXXXX | XXXXXXXXXXXX | XXXXXXXXXXXX |
| 228 | 101111101111 | XXXXXXXXXXXX | XXXXXXXXXXXX | XXXXXXXXXXXX |
| 229 | 011111101111 | XXXXXXXXXXXX | XXXXXXXXXXXX | XXXXXXXXXXXX |
| 230 | 111111101111 | XXXXXXXXXXXX | XXXXXXXXXXXX | XXXXXXXXXXXX |
| 231 | 111011011111 | 111011011111 | XXXXXXXXXXXX | XXXXXXXXXXXX |
| 232 | 010111011111 | 010111011111 | XXXXXXXXXXXX | XXXXXXXXXXXX |
| 233 | 110111011111 | 110111011111 | XXXXXXXXXXXX | XXXXXXXXXXXX |
| 234 | 101111011111 | 101111011111 | XXXXXXXXXXXX | XXXXXXXXXXXX |
| 235 | 011111011111 | 011111011111 | XXXXXXXXXXXX | XXXXXXXXXXXX |
| 236 | 111111011111 | 111111011111 | XXXXXXXXXXXX | XXXXXXXXXXXX |
| 237 | 111010111111 | 111010111111 | 111010111111 | XXXXXXXXXXXX |
| 238 | 010110111111 | 010110111111 | 010110111111 | XXXXXXXXXXXX |
| 239 | 110110111111 | 110110111111 | 110110111111 | XXXXXXXXXXXX |
| 240 | 101110111111 | 101110111111 | 101110111111 | XXXXXXXXXXXX |
| 241 | 011110111111 | 011110111111 | 011110111111 | XXXXXXXXXXXX |
| 242 | 111110111111 | 111110111111 | 111110111111 | XXXXXXXXXXXX |
| 243 | 010101111111 | 010101111111 | 010101111111 | 010101111111 |
| 244 | 110101111111 | 110101111111 | 110101111111 | 110101111111 |
| 245 | 101101111111 | 101101111111 | 101101111111 | 101101111111 |
| 246 | 011101111111 | 011101111111 | 011101111111 | 011101111111 |
| 247 | 111101111111 | 111101111111 | 111101111111 | 111101111111 |
| 248 | 101011111111 | 101011111111 | 101011111111 | 101011111111 |

TABLE-continued

| Coding of three border areas | | | | |
|---|---|---|---|---|
| Video value | Codeword standard | Codeword for $\Delta_3$ | Codeword for $\Delta_2$ | Codeword for $\Delta_1$ |
| 249 | 011011111111 | 011011111111 | 011011111111 | 011011111111 |
| 250 | 111011111111 | 111011111111 | 111011111111 | 111011111111 |
| 251 | 010111111111 | 010111111111 | 010111111111 | 010111111111 |
| 252 | 110111111111 | 110111111111 | 110111111111 | 110111111111 |
| 253 | 101111111111 | 101111111111 | 101111111111 | 101111111111 |
| 254 | 011111111111 | 011111111111 | 011111111111 | 011111111111 |

In the example shown in the table, the first column corresponds to the video value to be rendered, the second column to the standard codeword (used in the standard area of the panel as described on FIG. 18, the third, fourth and fifth respectively to the codeword used in the areas Δ1, Δ2, Δ3. In these three last columns, codeword xxxxxxxxxxxx means dropped codeword (not used).

For instance, in the area Δ1, the video values 33 up to 38 are not rendered whereas they are rendered in the two other areas.

Indeed, the video level 33 is rendered with the codeword 111010100000 in the standard area. In case of APL=0%, the 6th sub-field has an energy of 71 sustains which is more than Δ1 but lower than Δ2 and Δ3. In this codeword, the 6th sub-field is set to zero whereas the 7th is set to one, which represents a critical situation as described in FIG. 9. Therefore, the codeword is dropped for area Δ1 only.

Later on, the missing levels will be recreated by the means of dithering. Even if this concept will increase a bit the dithering noise in the border areas, it has to be remembered that those areas are very small (e.g. 4% of screen size) and do not represent the main area for the human eye. In that case the limitations introduced by the specific border coding will not be really noticeable for the viewer but the gain in terms of contrast (less priming used) will be quite strong. Indeed, in the example at APL=0%, one signal priming instead of 8 is enough, so that the contrast has been improved by a factor 8.

Following number of levels are suppressed in the example:

Δ1:145 codewords are suppressed

Δ2:109 codewords are suppressed

Δ3:79 codewords are suppressed

Moreover, fewer levels will be suppressed in the case of a combination with dynamic priming. In that case, a trade-off should be chosen between the number of sub-fields used for dropping and the number of additional priming. The ideal position for the primed sub-fields will be on the lowest sub-fields from the critical group (all sub-fields having more than Δn sustains) since the number of codewords to be dropped will be more reduced in that case.

Furthermore, the suppression is done only for law APL values as seen on FIG. 17.

A hardware implementation of the border-coding concept for a PDP panel is shown in FIG. 19. Input 8-bit R, G, B is forwarded to the video-degamma function block 1 (mathematical function or LUT), which outputs the signal with more resolution (at least 10 bits). This signal is forwarded both to a power measurement block 2 and to the video-mapping block 3. The power measurement block 2 measures the Average Power level APL of the video signal.

Depending on the Average Power Level (APL), the control system 4 determines the sustain table and the encoding table with its sub-fields number. Furthermore, this basic information APL is sent to a border select block 5 so that a correct decision regarding the critical areas can be taken. To do that, the border select block also disposes of position information (H-line and Clock-pixel) so that the right Δ area can be determined. Additionally, the border select block 5 receives a control signal BORD from the system control block 4. This control signal BORD is used for activating the specific border coding. The Δ information output from the border select block 5 as well as a mapping information (related to the encoding and sustain table) is sent to the video mapping block 3 which modifies the video data so that the dropped video parts can be recreated correctly with the dithering function.

After the mapping stage in video mapping block 3, data are forwarded to a dithering block 6 replacing non-encodable video levels. Then, the encoding to codewords of a 10 bit RGB signal from the dithering block 6 is performed by the sub-field coding block 7 receiving coding information from the system control block 4 concerning the decision which LUT should be used for sub-field coding.

The system control block 4 also controls the writing of 16 bit RGB pixel data from the sub-field coding block 7 in a 2-frame memory 8 (WR), the reading (RD) of RGB sub-field data from a second frame memory integrated in the 2-frame memory 8, and the serial to parallel conversion circuit (SP) in a serial-parallel conversion block 9 receiving the output signals SF-R, SF-G,SF-B from the 2-frame memory 8.

The 2-frame memory 8 is required, since data is written pixel-wise, but read sub-field-wise. In order to read the complete first sub-field a whole frame must already be present in the memory 8. In a practical implementation two whole frame memories are present, and while one frame memory is being written, the other is being read, avoiding in this way reading the wrong data. In a cost optimized architecture, the two frame memories are located on the same SDRAM memory IC, and the access to the two frames is time multiplexed.

The serial-parallel conversion block 9 outputs top and bottom data for the plasma display panel 10. Finally the system control block 4 including an addressing and sustain control unit 42 generates the SCAN and SUSTAIN pulses required to drive the PDP driver circuits of the PDP 10.

In summary in this document, it was shown how the use of a new coding concept can optimize the picture quality regarding the contrast as well as the response fidelity. Subjective tests performed in dark room environment have shown good picture quality assessment regarding classical PDPs.

The invention claimed is:

1. Method for processing video data to be displayed on a display screen by providing said video data having video levels selected from a predetermined number of video levels;

encoding said predetermined number of video levels with a corresponding number of subfield codewords, wherein to each bit of a subfield codeword a subfield is assigned, during which a cell of the display screen can be activated for light generation depending on the state of the corresponding bit of said subfield codeword;

comprising the following steps:

encoding the video levels of said video data in a central area of the display screen with the corresponding subfield codewords and encoding the video levels of said video data in a predetermined border area surrounding said central area of said display screen by using only those subfield codewords of said number of subfield codewords, which do not have a change of a subfield bit from a binary 0 to a binary 1 in a selectable part of the subfield codewords to prevent in said border area a cell which was not activated for a subfield in said selectable part from being activated for a following subfield in said selectable part, in order to avoid a response fidelity problem in said border area.

2. Method according to claim 1, wherein video levels corresponding to subfield codewords being not used are recreated by dithering.

3. Method according to claim 1, wherein said selectable part of the subfield codewords, which shall not have a change of a subfield bit from a binary 0 to a binary 1, is determined by a power level of a picture to be displayed.

4. Method of claim 1, wherein said part of the subfield codewords being determined to be with no change of a subfield bit from a binary 0 to a binary 1 includes the most significant bits of the subfield codewords.

5. Method according to claim 1, wherein the border area is divided into several sub-areas, a first one of said several sub-areas being illuminated by subfield codewords with a first selectable part with no change of a subfield bit from a binary 0 to a binary 1 and a second one of said several areas being illuminated by subfield codewords with a second selectable part with no change of a subfield bit from a binary 0 to a binary 1, which second selectable part includes the first selectable part of subfield codewords or at least a portion of it or which is different from the first selectable part.

6. Method according to claim 1, wherein cells of the display screen are subjected to dynamic priming.

7. Device for processing video data to be displayed on a display screen comprising:

data providing means for providing said video data having video levels selected from a predetermined number of video levels;

encoding means for encoding said predetermined number of video levels with a corresponding number of subfield codewords; and illuminating means for illuminating pixels in a central area of said display screen in accordance with said subfield codewords; wherein said illuminating means is adapted for illuminating pixels in a border area surrounding said central area of said display screen by using only those subfield codewords of said number of subfield codewords, which do not have a change of a subfield bit from a binary 0 to a binary 1 in a selectable part of the subfield codewords.

8. Device according to claim 7, further comprising dithering means for recreating video levels corresponding to subfield codewords being not used.

9. Device according to claim 7, further comprising a power level determining means for determining the power level of said video data, so that said part of the subfield codewords with no change of a subfield bit from a binary 0 to a binary 1 is determinable on the basis of said power level.

10. Device of claim 7, wherein said part of the subfield codewords being determined to be with no change of a subfield bit from a binary 0 to a binary 1 includes the most significant bits of the subfield codewords.

11. Device according to claim 7, wherein said illuminating means is adapted to divide said border area into several sub-areas, a first one of said several sub-areas being illuminable by subfield codewords with a first selectable part with no change of a subfield bit from a binary 0 to a binary 1 and a second one of said several sub-areas being illuminable by subfield codewords with a second selectable part with change of a subfield bit from a binary 0 to a binary 1, which second selectable part includes the first selectable part of subfield codewords or at least a portion of it or which is different from the first selectable par.

12. Device according to claim 7, further comprising dynamic priming means for dynamically priming cells of the display screen.

13. Method for processing video data to be displayed on a display screen by providing said video data having video levels selected from a predetermined number of video levels; and encoding said predetermined number of video levels with a corresponding number of subfield codewords, wherein to each bit of a subfield codeword a subfield is assigned, during which a cell of the display screen can be activated for illuminating pixels depending on the state of the corresponding bit of said subfield codeword comprising the following steps:

encoding the video levels of said video data in a central area of the display screen with the corresponding subfield codewords; and encoding the video levels of said video data in a predetermined border area surrounding said central area of said display screen by using only those subfield codewords of said number of subfield codewords, which do not have a binary 0between two binary 1 in a selectable part of the subfield codewords to prevent in said border area a cell which was not activated for a subfield in said selectable part from being activated for a following subfield in said selectable part, in order to avoid a response fidelity problem in said border area.

14. Device for processing video data to be displayed on a display screen comprising:

data providing means for providing said video data having video levels selected from a predetermined number of video levels;

encoding means for encoding said predetermined number of video levels with a corresponding number of subfield codewords, wherein to each bit of a subfield codeword a subfield is assigned, during which a cell of the display screen can be activated for illuminating pixels depending on the state of the corresponding bit of said subfield codeword; and illuminating means for illuminating pixels in a central area of said display screen in accordance with said subfield codewords;

wherein said illuminating means is adapted for illuminating pixels in a border area surrounding said central area of said display screen by using only those subfield codewords of said number of subfield codewords, which do not have a binary 0 between two binary 1 in a selectable part of the subfield codewords to prevent in said border area a cell which was not activated for a subfield in said selectable part from being activated for a following subfield in said selectable part, in order to avoid a response fidelity problem in said border area.

* * * * *